United States Patent [19]

Omura

[11] Patent Number: 5,018,419

[45] Date of Patent: May 28, 1991

[54] USED INK RIBBON CUTTING APPARATUS

[75] Inventor: Motoko Omura, Osaka, Japan

[73] Assignee: Fuji Kagakushi, Kogyo Co., Ltd., Osaka, Japan

[21] Appl. No.: 397,173

[22] Filed: Aug. 22, 1989

[30] Foreign Application Priority Data

Aug. 24, 1988 [JP] Japan ..... 63-110952

[51] Int. Cl.[5] ..... B26D 5/08; B26D 7/01

[52] U.S. Cl. ..... 83/451; 83/620; 83/697; 83/948; 83/953; 30/303

[58] Field of Search ..... 83/620, 697, 451, 948, 83/949, 953, 618, 628, 563; 30/303, 315

[56] References Cited

U.S. PATENT DOCUMENTS

| | | | |
|---|---|---|---|
| 880,057 | 2/1908 | Wheeler | 30/303 X |
| 2,196,619 | 4/1940 | Andresen | 83/618 X |
| 3,190,330 | 6/1965 | Hawkins | 30/303 X |
| 3,430,290 | 3/1969 | Kinslow, Jr. | 83/628 X |
| 4,436,025 | 3/1984 | Jones | 83/451 |
| 4,622,876 | 11/1986 | Napierski | 83/618 |

*Primary Examiner*—Douglas D. Watts
*Assistant Examiner*—Eugenia A. Jones
*Attorney, Agent, or Firm*—Edwin E. Greigg; Ronald E. Greigg

[57] ABSTRACT

An apparatus for cutting a used ink ribbon wound in a pancake form, comprising a ribbon holder for setting a position of the ink ribbon, and a plurality of cutting blades extending radially on one surface of a base member movable relative to the ink ribbon. When the base member is driven to the ink ribbon, the cutting blades cut the ink ribbon through a plurality of cutting planes extending radially from the axis of the ink ribbon in a pancake form.

6 Claims, 10 Drawing Sheets

USED INK RIBBON CUTTING APPARATUS

BACKGROUND OF THE INVENTION

The present invention relates to an apparatus for cutting or shredding a used one-time ink ribbon wound in a pancake form.

A one-time ink ribbon wound in a pancake form has a thermal transfer ink layer formed on one face of a base material. Parts of the ink layer are heated by a thermal head for transfer to recording paper. Thus, traces of print remain on the used ink ribbon which, if disposed of carelessly, could result in leakage of secret information.

Conventionally, therefore, used ink ribbons are cut to small pieces by means of shredders or the like.

Ink ribbons of th type noted above, however, are very thin having a thickness 5 to 20 micrometers, and besides the base material comprises a very soft plastic film. Such thin and soft ink ribbons just become bent at positions of contact with rotary blades of a thredder or the like. It has been practically impossible to reliably cut those ink ribbons to desired sizes.

Moreover, since such an ink ribbon has a great length, it is a very time-consuming operation to unwind the ink ribbon in a pancake form for shredding one portion after another.

SUMMARY OF THE INVENTION

An object of the present invention is to provide an ink ribbon cutting apparatus capable of cutting a used ink ribbon to small pieces with ease, which is achieved by effectively utilizing the compact disk-like state of the used ink ribbon wound in a pancake state.

The above object is achieved, according to the present invention, by a used ink ribbon cutting apparatus comprising a base for supporting the ink ribbon in the pancake form, a positioning member for setting a position of the ink ribbon relative to the base, and a plurality of cutting blades arranged in a predetermined positional relation to the positioning member, wherein the cutting blades cut the ink ribbon through a plurality of cutting planes extending radially from an axis of theink ribbon.

With the above cutting apparatus, a used ink ribbon is placed and supported as compactly wound on the base. At this time the ink ribbon is maintained in position on the base buy the position setting member. This apparatus comprises a plurality of cutting blades as noted above, and these cutting blades cut the compactly wound ink ribbon cutting through a plurality of cutting planes extending radially from the axis of the wound ink ribbon. As a result, the ink ribbon is cut into a plurality of parts. With this apparatus, the ink ribbon is maintained with each wind of the ribbon supported by adjacent winds, and the cutting blades apply a cutting action to each wind in directions perpendicular to its circumferential direction which is the running direction of the ribbon. Consequently, the ribbon is cut easily and reliably.

With this cutting apparatus, therefore, it is possible to cut the ink ribbon with a positive but light force applied to the cutting blades, which is achieved by utilizing the compactly wound state of the used ink ribbon. Further, since the ink ribbon is cut through a plurality of cutting planes extending radially from the axis of theink ribbon, the ink ribbon is cut at plural circumferential positions in one operation whicle remaining in the pancake form. This apparatus is thus capable of cutting the used ink ribbon to small pieces very simply and quickly compared with the conventional cutting method. Since secret information is recorded continuously along the ribbon, the cutting mode according to the present invention positively prevents leakage of the continuous information due to ribbon cutting errors.

In a preferred embodiment of the invention, the base includes a first base member with the positioning member located centrally thereof and the cutting blades arranged radially around the positioning member, and a planar base member provided independently of the first base member for supporting the ink ribbon, the cutting blades being movable relative to and axially of the ink ribbon.

With this construction, the ink ribbon is supported on the planar base member and positioned relative to the plurality of cutting blades by the position setting member included in the first base member. When the first base member is pressed toward the ink ribbon, the cutting blades divide the ink ribbon in a pancake form into a plurality of sectors. The planar base member may be provided specially for the purpose or may comprise an ordinary working table. Such a construction provides a simple chopper type cutting apparatus which produces desired results.

In another embodiment of the invention, the base includes a first base member for supporting the ink ribbon held in position by the positioning member, and a second base member for supporting the cutting blades as opposed to the ink ribbon and arranged radially with respect to an axis thereof, the cutting blades being movable relative to and axially of the ink ribbon.

This cutting apparatus can cope with a relatively heavy duty and can be automated with ease.

In a further preferred embodiment, the base acts also as the positioning member and includes a portion for positioning outer peripheries of the ink ribbon, the cutting blades being arranged radially and outwardly of the ink ribbon and at substantially the same height as the ink ribbon, and the cutting blades being movable together radially relative to the ink ribbon.

This cutting apparatus is compact and easy to use, without requiring a large vertical space.

Other features and advantages of th present invention will be apparent from the following description.

BRIEF DESCIPTION OF THE DRAWINGS

Figure 1:
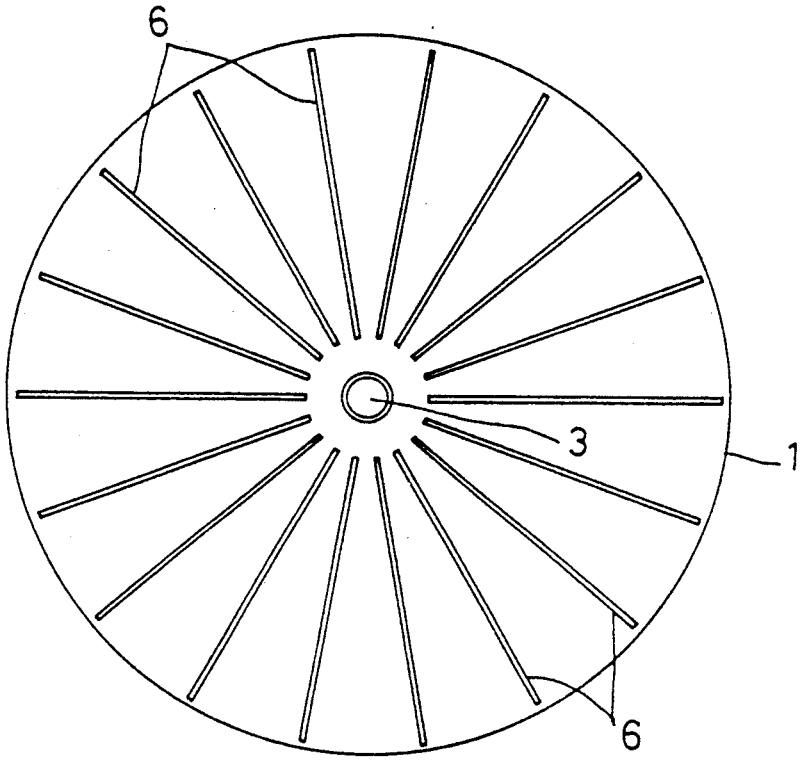
FIG. 1 is a front view of an apparatus for cutting a used ink ribbon according to a first embodiment of the present invention.
Figure 2:
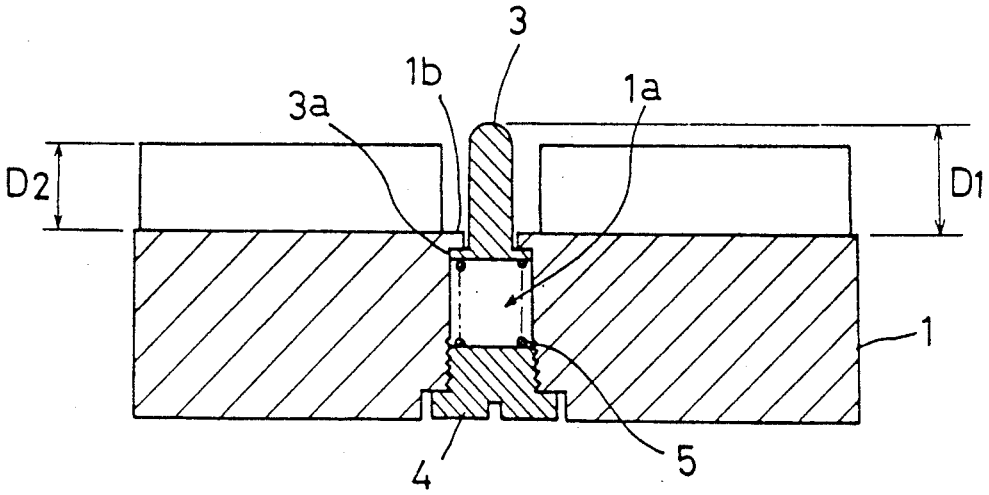
FIG. 2 is a sectional view of the cutting apparatus.
Figure 3:
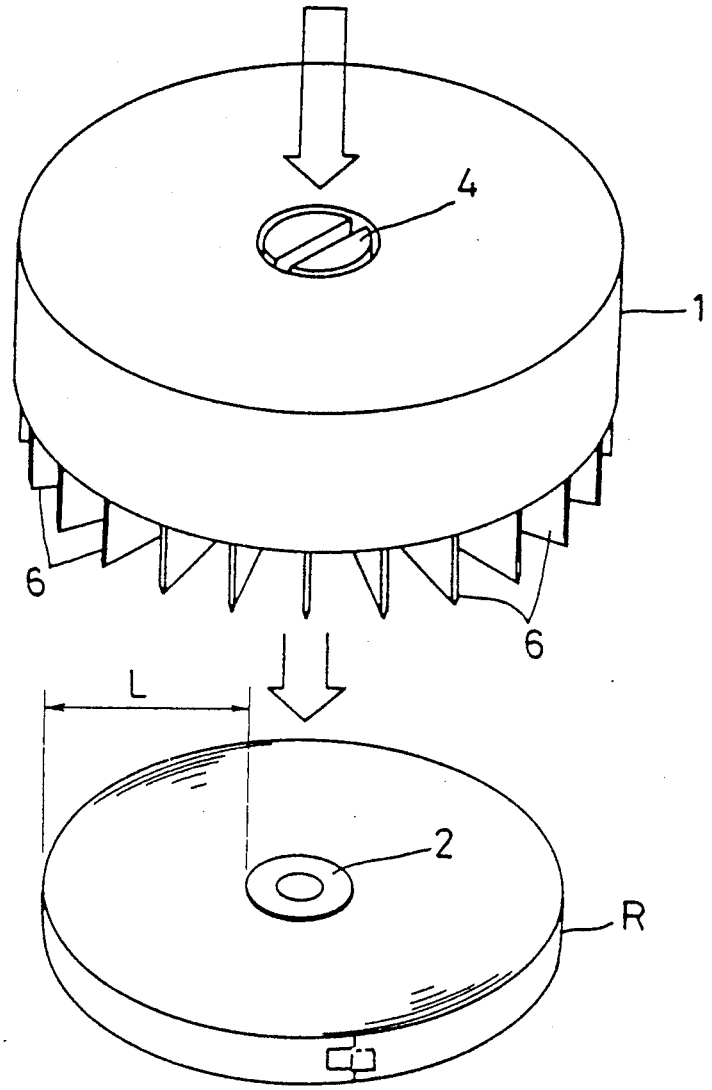
Figure 4:
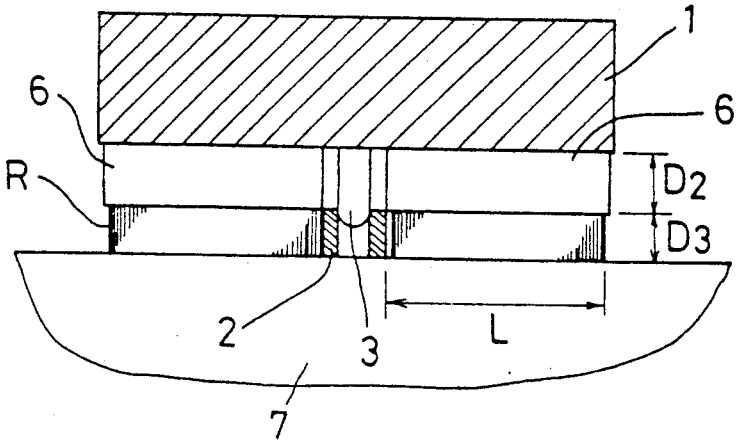
Figure 5:
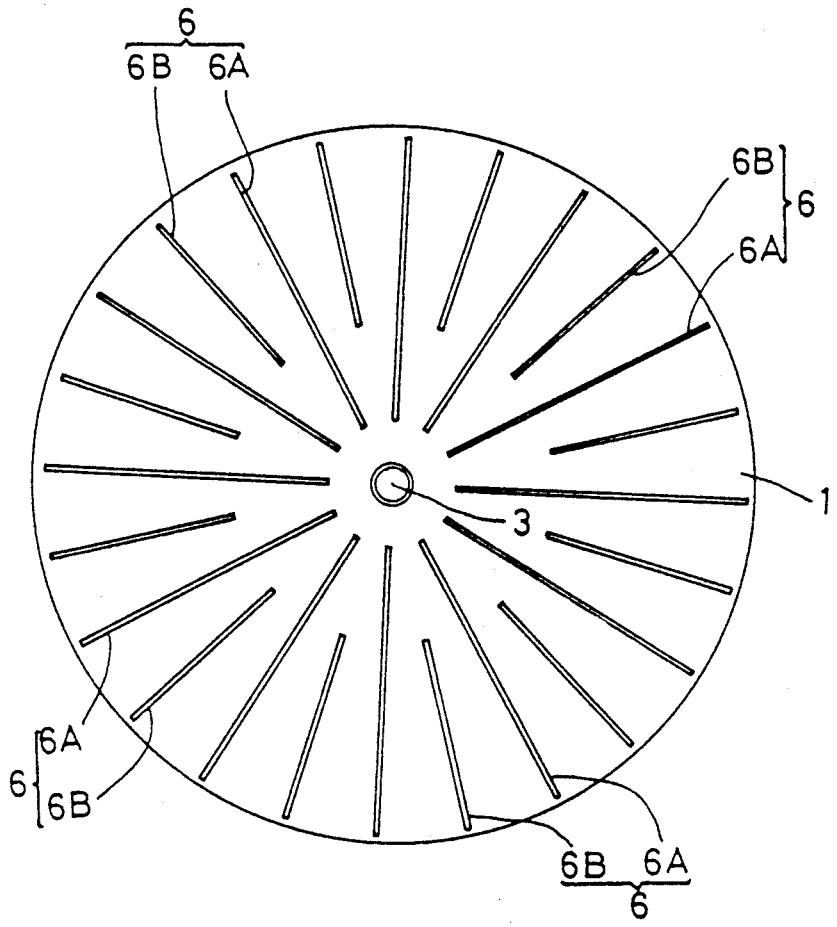
Figure 6:
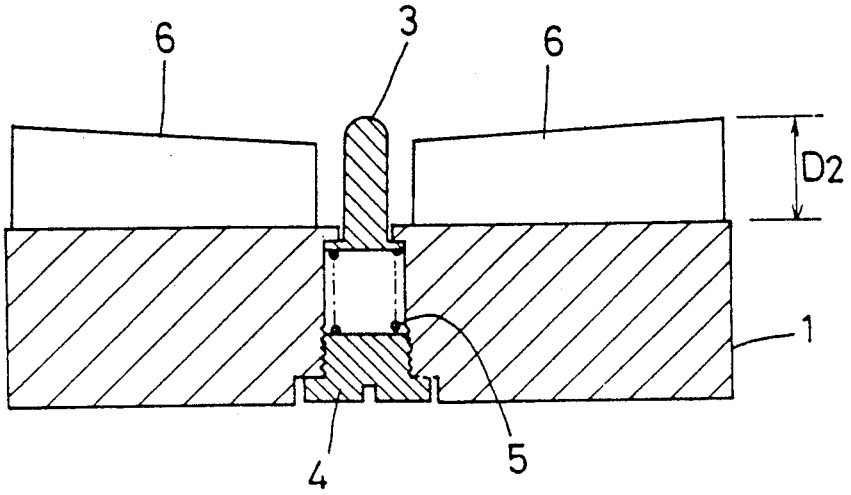
Figure 7:
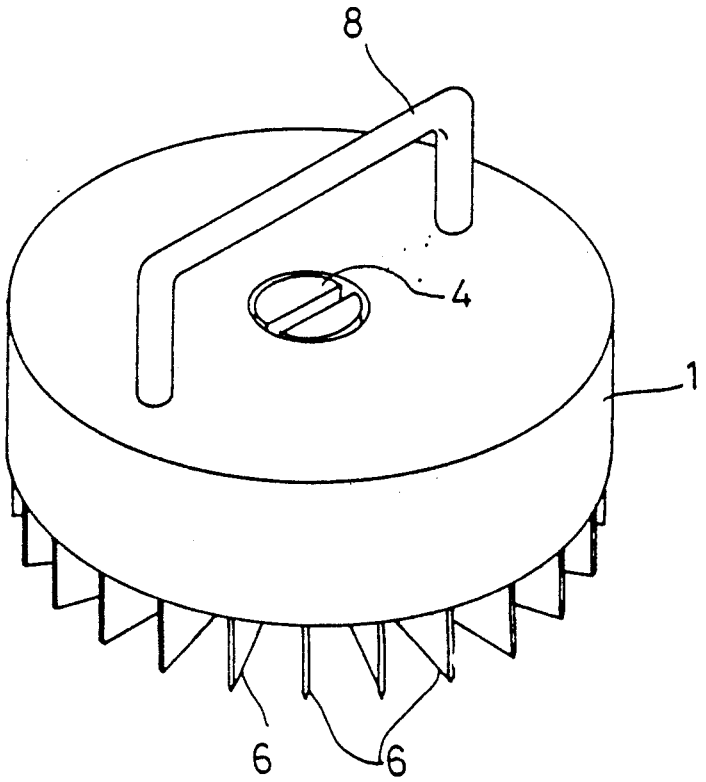
Figure 8:
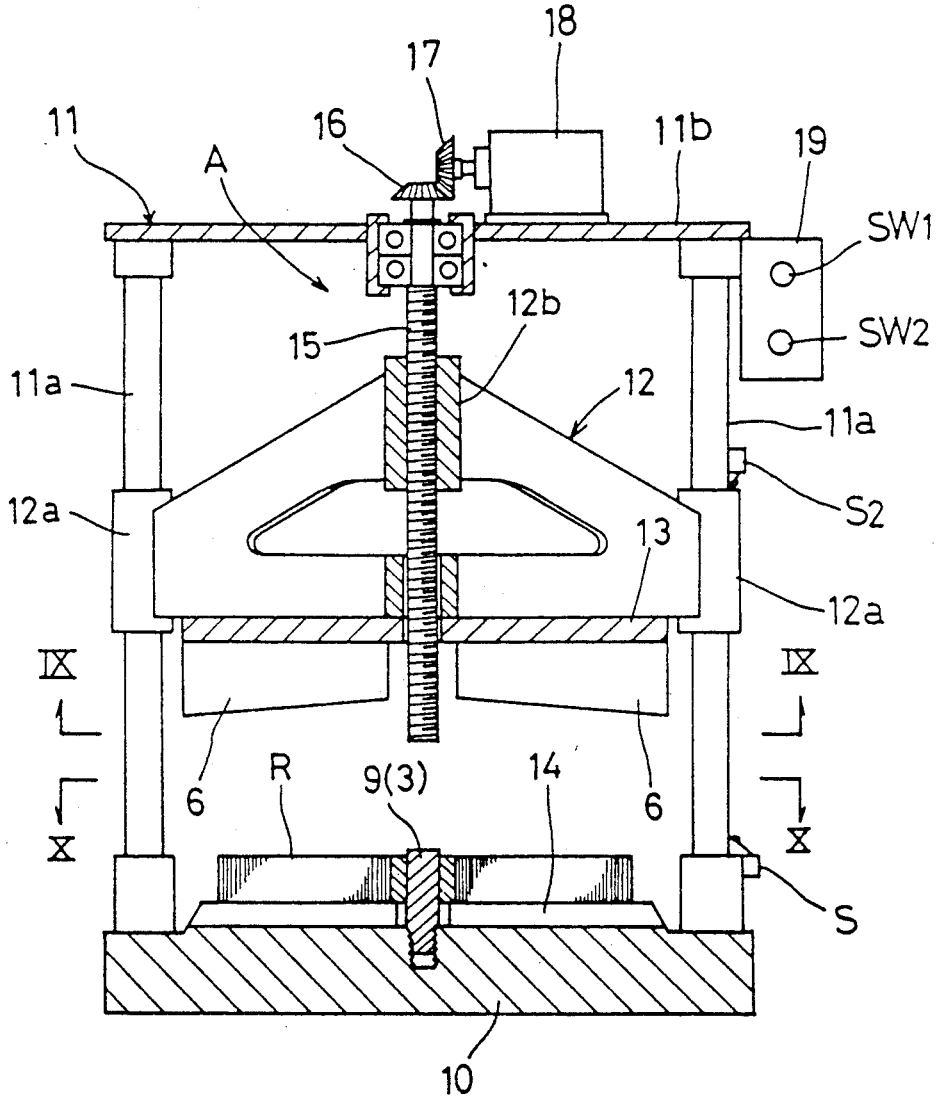
Figure 9:
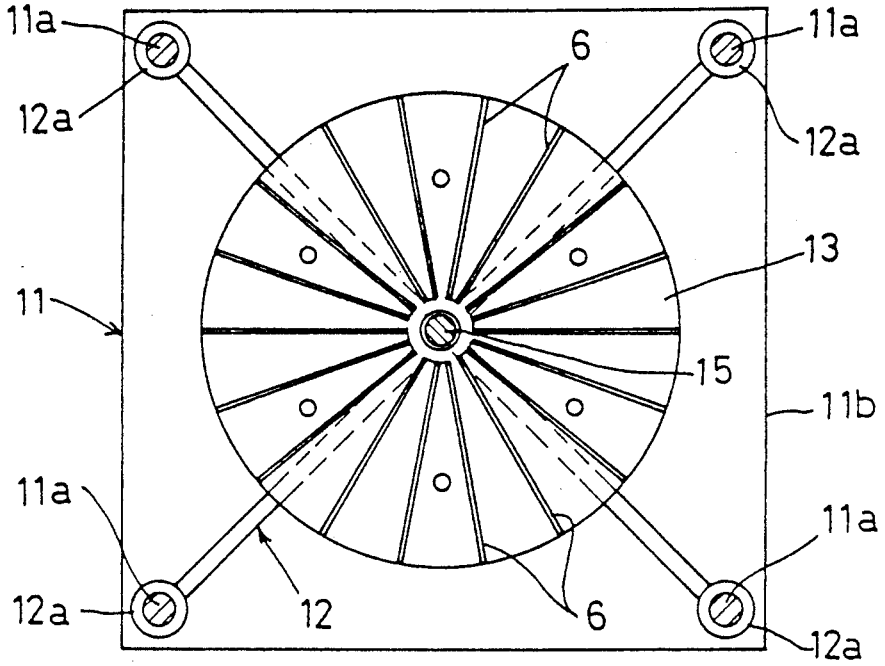
Figure 10:
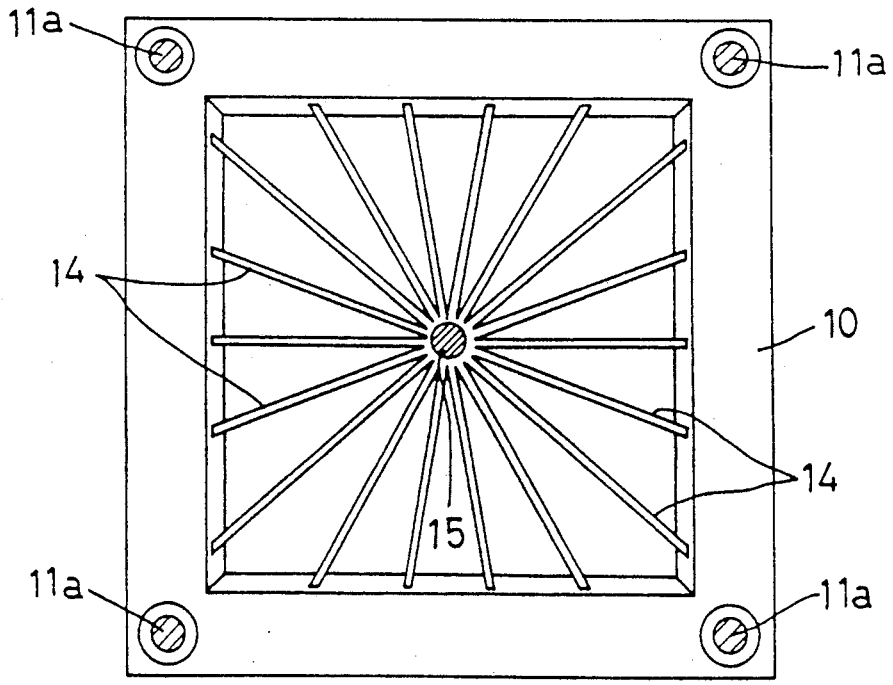
Figure 11:
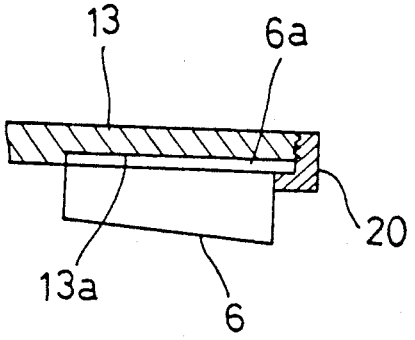
Figure 12:
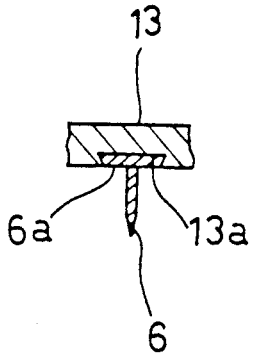
Figure 13:
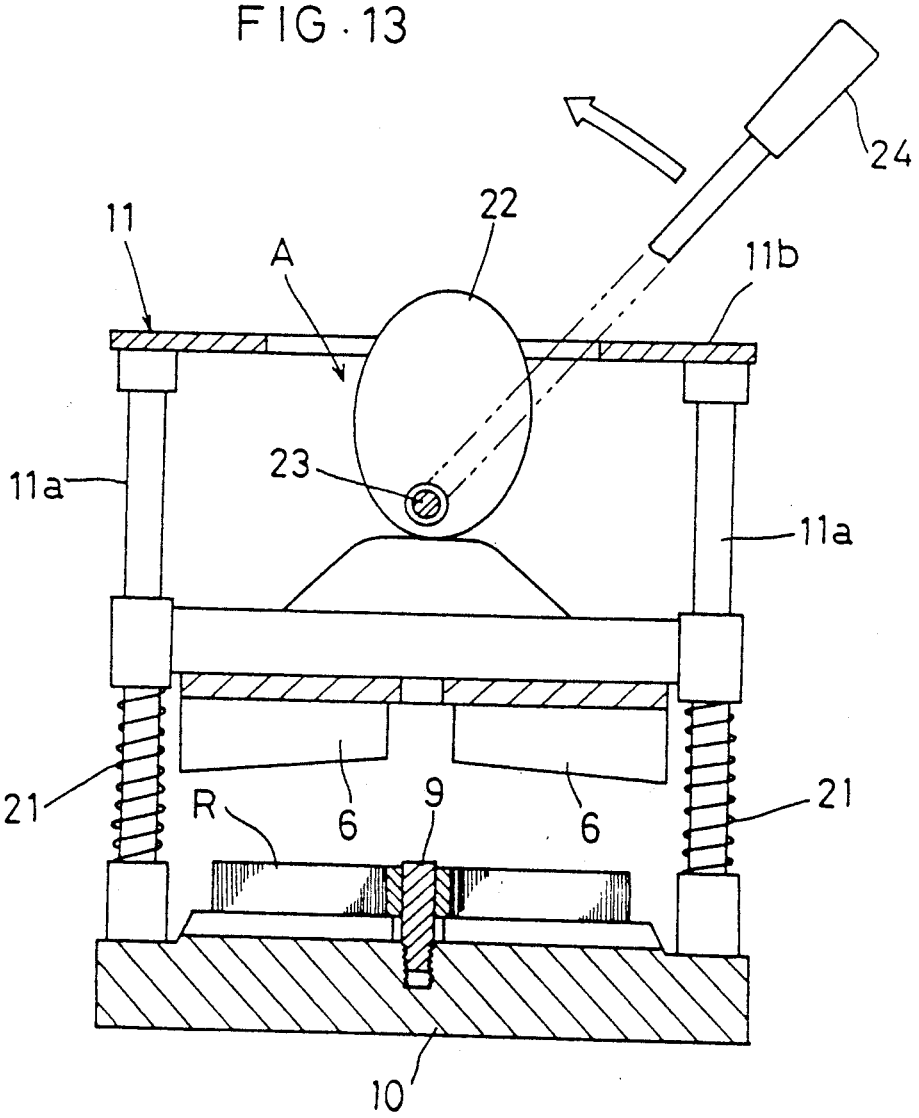
Figure 14:
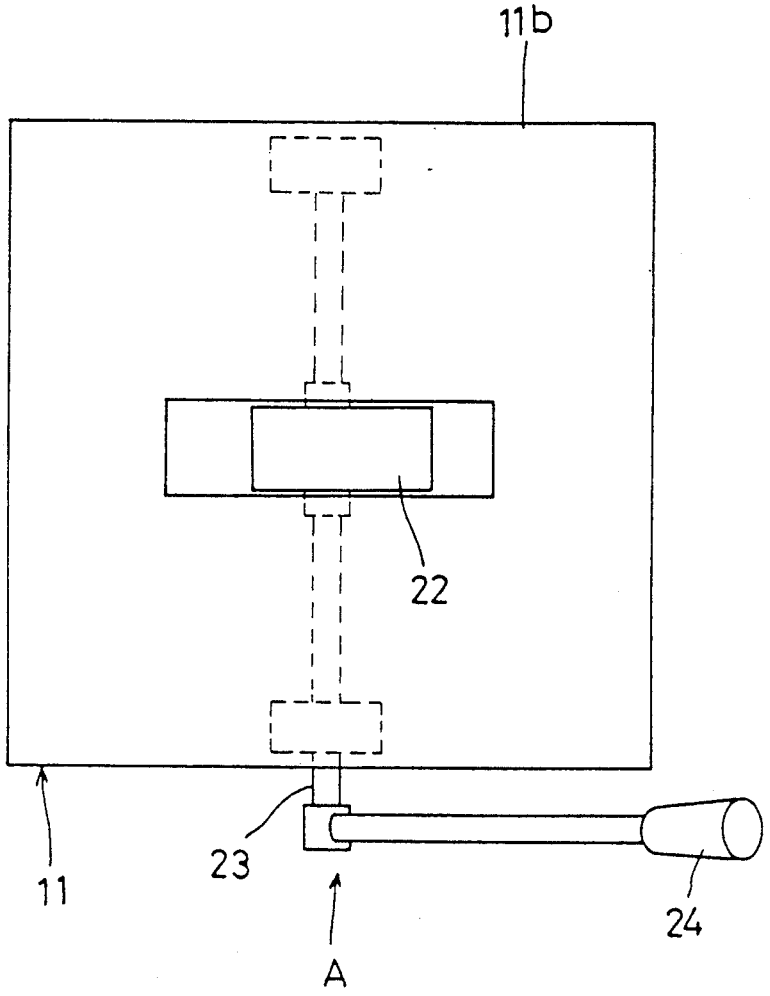
Figure 15:
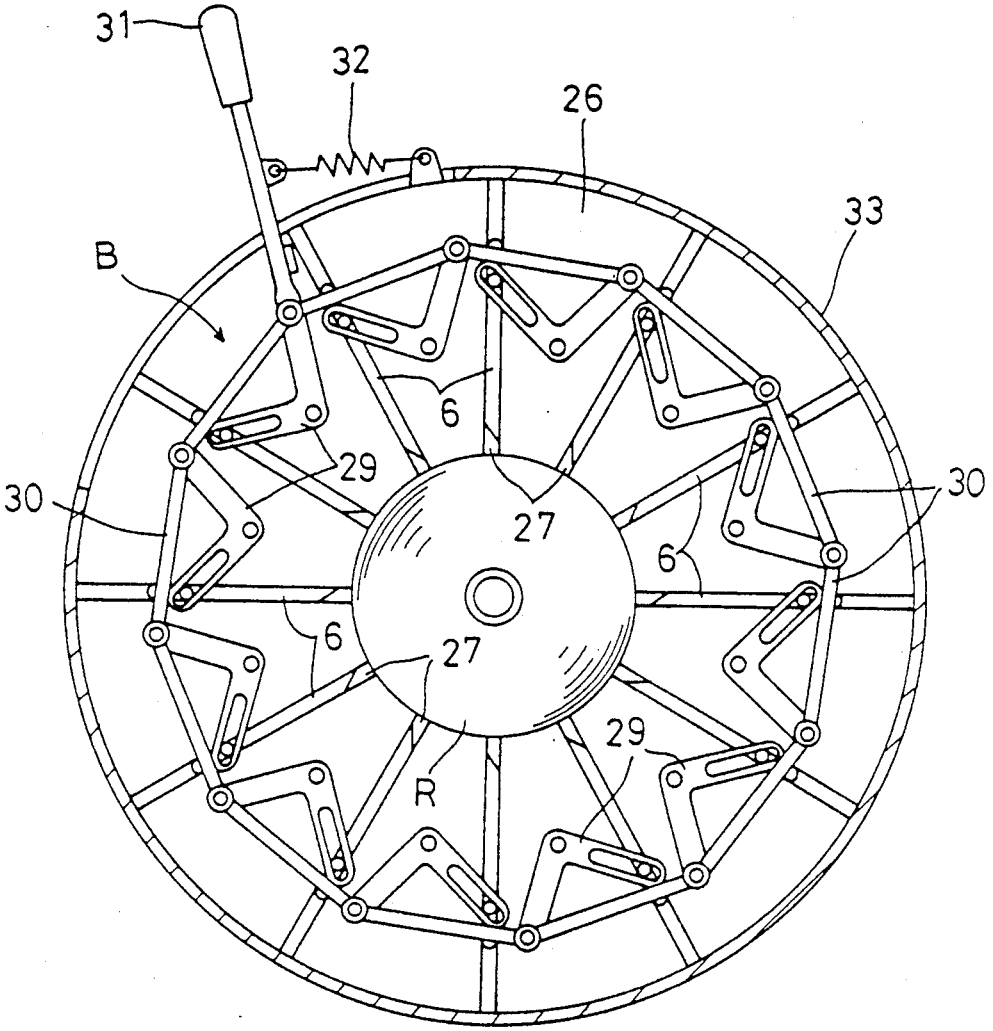
Figure 16:
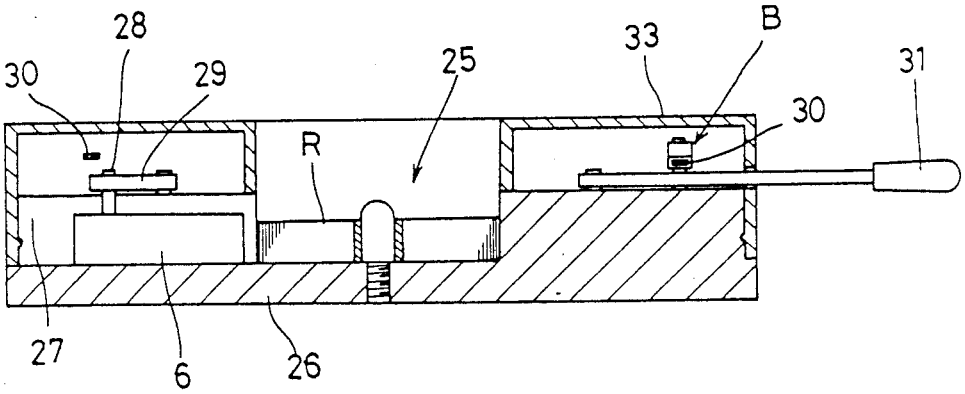
Figure 17:
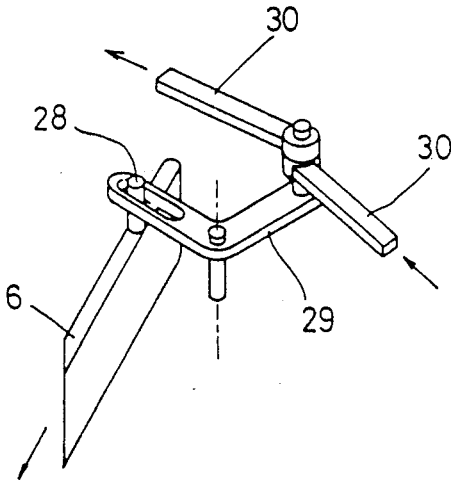

FIG. 3 is a perspective view of the cutting apparatus ingaged in a ribbon cutting operation, FIG. 4 is sectional view of the cutting apparatus ingaged in the ribbon cutting operation, FIG. 5 is a front view of an ink ribbon cutting apparatus according to a second embodiment of the invention, FIG. 6 is a sectional view of an ink ribbon cutting apparatus according to a third embodiment, FIG. 7 is a perspective view of an ink ribbon cutting apparatus according to a fourth embodiment, FIG. 8 is a front view of an ink ribbon cutting apparatus according to a fifth embodiment, FIG. 9 is a section taken on line IX—IX of FIG. 8, FIG. 10 is a section taken on line X—X of FIG. 8, FIGS. 11 and 12 are sectional views of a principal portion of an ink ribbon cutting apparatus according to a sixth embodiment, FIG. 13 is a front view of an ink ribbon cutting apparatus according to a seventh embodiment, FIG. 14 is a plan view of the apparatus shown in FIG. 13, FIG. 15 is a cross section of an ink ribbon cutting apparatus according to an eighth embodiment, FIG. 16 is a vertical section of the apparatus shown in FIG. 15, and FIG. 17 is a perspective view of a principal portion of the apparatus shown in FIGS. 15 and 16.

DETAILED DESCRIPTION OF THE PREFERRED EBODIMENTS

FIGS. 1 through 4 show an apparatus for cutting a used ink ribbon R according to a first embodiment of the present invention. This cutting apparatus comprises a first base 1 having a disk-like shape and a size that can be held by the user. A core holder 3 is movably mounted in a bore 1*a* defined centrally of the first base 1 to act as a positioning member that extends into a center core 2 of the used ink ribbon R. The core holder 3 includes a bottom flange 3*a* engageable with an annular projection 1*b* formed at one end of the bore 1*a*.

A plug 4 is screwed to the other end of the bore 1*a*. The bore 1*a* contains a compression spring 5 extending between the plug 4 and the bottom flange 3*a* of core holder 3 to urge the core holder 3 outwardly of the first base 1.

The first base 1 includes a plurality of cutting blades 6 fixed to the face of the base 1 defining the annular projection 1*b*. These cutting blades 6 extend radially with respect to the axis of the core holder 3, and define cutting edges the length of which exceeds a winding radius L of the ink ribbon R.

The cutting blades 6 have radially inward ends located slightly outwardly of outer peripheries of the core 2 of the ink ribbon R mounted in position, so that the cutting blades 6 are out of contact with the core 2 during a cutting operation. This construction is incapable of cutting several winds of the ink ribbon R adjacent the core 2. However, this portion of the ink ribbon R is not used for printing, and presents no problem even if left uncut.

The core holder 3 in a natural state project to a greater extent as at D1 than an extednt of projection D2 of the cutting blades 6. Consequently, the core holder 3 enters the core 2 before the cutting blades 6 contact a side face of the wound ink ribbon R to be cut.

The extent of projection D2 of the cutting blades 6 is greater than a width D3 of the ink ribbon R. This cutting apparatus may be used for cutting ink ribbons having different widths.

When cutting the used ink ribbon R with the cutting apparatus as constructed above, the core holder 3 of the first base 1 is aligned to the core 2 of the used ink ribbon R placed on a working table 7 which is one exampble of planar bases. Thereafter, the cutting blades 6 of the first base 1 are brought into contact with a side face of the wound ink ribbon R. In this state the user presses the first base 1 hard from behind with his or her hand. This causes the cutting blades 6 to cut transversely into the used ink ribbon R, whereby the ink ribbon R wound in a pancake form is shredded into small strips.

When cutting the used ribbon R, it is preferable that a working mat formed of rubber or other elastic material is placed on the planar working table 7.

The number, length and spacing of the cutting blades 6 may be selected according to the size of used ink ribbon R or a desired cutting width.

A second embodiment of the invention will be described next.

As distinct from the first embodiment in which all the cutting blades 6 have the same length, the second embodiment, as shown in FIG. 5, includes two types, one longer than the other, of cutting blades 6A and 6B arranged alternately in the peripheral direction. In this embodiment, therefore, the cutting blades are not densely arranged adjacent the center of the used ink ribbon R. This construction has the adavntage of facilitating assembly of the cutting blades while allowing the ink ribbon R to be cut into desired widths.

FIG. 6 shows a third embodiment of the invention. In the first embodiment, the extent of projection D2 of the cutting blades 6 is uniform longitudinally of the cutting blades 6 so that the entire edges of cutting blades 6 simultaneously contact a side face of the used ink ribbon R. In the third embodiment, the cutting blades 6 are tapered with the extent of projection D2 increasing longitudinally outwardly of the cutting blades 6.

FIG. 7 shows a fourth embodiment which includes a handle 8 fixed to the back face of the first base 1 as distinct from the first embodiment in which the entire first base 1 is held with a hand.

FIGS. 8 through 10 show an ink ribbon cutting apparatus according to a fifth embodiment of the invention. This cutting apparatus comprises a first base 10 including a ribbon holder 9 for removably holding a used ink ribbon R, and a frame 11 erected on the first hase 10 and approximately gate-shaped in front view.

The gate-shaped frame 11 includes four struts 11*a* for slidably supporting guide tubes 12*a* of a vertically movable slide frame 12.

The slide frame 12 carries a second base 13 removably attached to a bottom surface thereof. The second base 13 includes radially extending cutting blades 6 secured to the face thereof opposed to the ribbon holder 9. This apparatus further comprises a cutting control section A for raising and lowering the second base 13 relative to the first base 10 and radially of the used ink ribbon R mounted on the ribbon holder 9.

The ribbon holder 9 comprises a core holder 3 screwed to a central position of the first base 1 to act as a positioning member that extends into the center core 2 of the used ink ribbon R. The core holder 3 is interchangeable with different core holders to suit shapes of the core 2 of the used ink ribbon R.

The first base 1 defines radial grooves 14 on a top surface thereof for receiving the cutting blades 6 descending with the second base 13 when cutting the used ink ribbon R.

The cutting control section A includes a screw shaft 15 rotatable about a vertical axis and supported by a horizontal frame 11*b* supported on the tops of the four struts 11*a* of the gate-shaped frame 11, and an electric motor 18 having a bevel gear 17 meshed with a bevel gear 16 attached to an upper end of the screw shaft 15. The screw shaft 15 has a male screw meshed with a female screw 12*b* of the slide frame 12. The electric motor 18 is rotatable forward and backward to vertically drive the slide frame 12.

The gate-shaped frame 11 supports a control panel 19 including a starter switch SW1 and an emergency stop switch SW2 for controlling the electic motor 18. The gate-shaped frame 11 further supports a first sensor S such as a limit switch for detecting the slide frame 12 having descended to a position for completing ribbon cutting, and a second sensor S2 for detecting the slide frame 12 having ascended to a predetermined standby position.

When the starter switch SW1 is turned on, the electric motor 18 rotates forward to lower the slide frame 12. Then the cutting blades 6 movable with the slide frame 12 cut in from one face of the used ink ribbon R as held by the ribbon holder 9 of the first base 10. As a result, the ink ribbon R is cut transversely.

When the first sensor S detects completion of this cutting operation, the electric motor 18 rotates backward in response to a signal output from the first sensor S, to automatically raise the slide frame 12. When the second sensor S2 detects the slide frame 12 having reached the standby position, the electric motor 18 stops in response to a signal output from the second sensor S2.

Where the electric motor 18 comprises a stepper motor, the number of pulses for driving the stepper motor indicates the current position of the slide frame 12. Therefore, the sensors S and S2 may be despensed with, and upper and lower limits of movement of the slide frame 12 may be varied freely in accordance with the type of the used ink ribbon R.

The second base 13 may be constructed rotatable relative to the slide frame 12 for scattering cut ink ribbon pieces radially outwardly. Such a construction has the advantage of preventing leakage of secret information with increased reliability in that the cut ink ribbon pieces become mixed up.

FIGS. 11 and 12 show a sixth embodiment which differs from the fifth embodiment in the attachment structure of the cutting blades 6. In this embodiment, the second base 13 defines dovetail grooves 13*a*, and each of the cutting blades 6 includes a mounting portion 6*a* slidable into each dovetail groove 13*a* from a radially outward end thereof. A retainer ring 20 is removably screwed onto the second base 13 for stopping the cutting blades 6 from pulling out of the grooves 13*a*. This embodiment has an advantage of allowing the cutting blades 6 to be changed freely in accordance with the type of used ink ribbon R.

FIGS. 13 and 14 show a seventh embodiment which differs from the fifth embodiment in the cutting control section A. This embodiment includes compression springs 21 provided on the struts 11*a* of the gate-shaped frame 11 for upwardly urging the slide frame 12, and a control shaft 23 supported by the horizontal frame 11*b* of the gate-shaped frame 11 to be rotatable on a horizontal axis, the control shaft 23 carrying an eccentric cam 22 for contacting an upper surface of the slide frame 12. A control lever 24 is fixed to one end of the control shaft 23. When the control lever 24 is turned in the direciton indicated by an arrow, the eccentric cam 22 is turned therewith to depress the slide frame 12. As a result, the cutting blades 6 cut the ink ribbon R in a pancake form to small pieces.

FIGS. 15 through 17 show an ink ribbon cutting apparatus according to an eighth embodiment of the invention. This apparatus comprises a base 26 including a ribbon holder 25 for removably holding a used ink ribbon R. The base 26 defines, on an upper surface thereof, grooves 27 extending radially with respect to the center of the ribbon holder 25. A cutting blade 6 is movably mounted in each groove 27. This cutting apparatus further comprises a cutting control section B for moving the cutting blades 6 radially of the ink ribbon R held by the ribbon holder 25. This is, the base 26 per se acts also as a positioning device to hold peripheries of the ink ribbon R in position.

The cutting control section B includes operating arms 29 pivotably attached to the upper surface of the base 26, each arm 29 being approximately L-shaped in plan view and engageable with a pin 28 fixed to each cutting blade 6. An adjacent pair of operating arms 29 is pivotally interconnected through a rod 30. A control lever 31 is connected to one of the operating arms 29. A tension spring 32 extends between the control lever 31 and the base 26 for urging and retracting the cutting blades 6 radially outwardly to standby positions.

When the control lever 31 is operated against the resilient urging force of the tension spring 31, the cutting blades 6 are moved radially inwardly by the pivotally interconnected operating arms 29. As a result, the used ink ribbon R wound in a pancake form and held by the ribbon holde 25 of the base 26 is shredded to small strips.

Number 33 in the drawings indicates a cover removably attached to the base 26 for covering upper positions of the operating arms 29 and rod 30 as well as the cutting blades 6 in the standby positions.

The foregoing embodiments are constructed to cut used ink ribbon R only. However, the present invention may be embodied such that the core 2 disposed centrally of the used ink ribbon R is cut at the same time. In this case, the force required for cutting the core may be greatly reduced by forming slits in cutting positions of the core 2 in advance.

The present invention is of course applicable also to used ink ribbons having no core.

The foregoing embodiments have been described in relation to cutting one used ink ribbon R. However, a plurality of ink ribbons may be placed in a stack to be cut simultaneously.

In the foregoing embodiments, the user manually places the ink ribbon R in position for the cutting operation and collects cut ribbon pieces. These operations may be carried out automatically by adding a ribbon mounting mechanism and a cut ribbon discharging mechanism.

The cutting control sections A and B and ribbon holders 9 and 25 are not limited to the described constructions, but may be modified in many ways taking various conditions into account, such as types of the used ink ribbons R and working situations.

Moreover, in the described embodiments, the cutting blades 6 extend radially with respect to the center of the ink ribbon R. It is, however, not absolutely necessary to arrange radially with respect to the center of theink ribbon. It will be sufficient if the cutting blades 6 on the whole are arranged approximately radially to be able to cut the ink ribbon.

What is claimed is:

1. An apparatus for cutting a used ink ribbon wound in a pancake form, comprising:

a first base member for supporting the ink ribbon in the pancake form, a positioning member for setting a position of the ink ribbon relative to said first base member, a first plurality of cutting blades arranged on a second base member in a predetermined radially extending position relative to said positioning member, and a second plurality of cutting blades, each of said second plurality of cutting blades being equally spaced between each of said first plurality of cutting blades, of a shorter length than each of said first plurality of cutting blades, and extending inwardly in a radial direction from an outer periphery of said second base member toward said positioning member, wherein said first plurality of cutting blades cut said ink ribbon through a plurality of cutting planes extending radially from an axis of said ink ribbon and said second plurality of blades cut said ink ribbon from an outer perimeter radially inwardly toward said axis of said ink ribbon.

2. An apparatus as claimed in claim 1, wherein said positioning member is located centrally of said second base member, said first plurality of cutting blades are arranged radially around said positioning member and said postioning member extends outwardly of said plurality of cutting blades, said first base member is provided independently of said second base member for supporting said ink ribbon, and said first and second plurality of cutting blades are movable along an axis relative to said ink ribbon.

3. An apparatus as claimed in claim 2, wherein said positioning member comprises a core holder for insertion into a core located centrally of said ink ribbon.

4. An apparatus as claimed in claim 1, wherein said first base member supports said ink ribbon and includes said positioning member coaxially therein.

5. An apparatus as claimed in claim 4, wherein said positioning member comprises a core holder for insertion into a core located centrally of said ink ribbon.

6. An apparatus as claimed in claim 1, wherein said first base member said ink ribbon removably mounted thereon.

* * * * *

UNITED STATES PATENT AND TRADEMARK OFFICE

CERTIFICATE OF CORRECTION

PATENT NO. : 5,018,419

DATED : May 28, 1991

INVENTOR(S) : Motoko OHMURA

It is certified that error appears in the above-identified patent and that said Letters Patent is hereby corrected as shown below:

On the title page, correct the inventor's name as follows:

[75] Inventor: Motoko Ohmura, Osaka, Japan

Signed and Sealed this

Twenty-second Day of December, 1992

*Attest:*

DOUGLAS B. COMER

*Attesting Officer*

*Acting Commissioner of Patents and Trademarks*